US007645117B2

(12) United States Patent
Bracken et al.

(10) Patent No.: US 7,645,117 B2
(45) Date of Patent: Jan. 12, 2010

(54) ROTARY MACHINES AND METHODS OF ASSEMBLING

(75) Inventors: Robert James Bracken, Niskayuna, NY (US); David Orus Fitts, Ballston Spa, NY (US); Sterling Hathaway, Schenectady, NY (US); William Edward Adis, Scotia, NY (US); Ronald Korzun, Clifton Park, NY (US); Larry Duclos, Thorndike, ME (US)

(73) Assignee: General Electric Company, Schenectady, NY (US)

( * ) Notice: Subject to any disclaimer, the term of this patent is extended or adjusted under 35 U.S.C. 154(b) by 396 days.

(21) Appl. No.: 11/381,799

(22) Filed: May 5, 2006

(65) Prior Publication Data

US 2007/0258826 A1 Nov. 8, 2007

(51) Int. Cl.
*F01D 11/08* (2006.01)

(52) U.S. Cl. ..... 415/173.3; 415/173.4; 415/173.7; 415/191; 416/208; 29/889.22

(58) Field of Classification Search ..... 415/170.1, 415/173.1, 173.3, 173.4, 173.7, 174.2, 174.4, 415/191, 213.1; 416/204 R, 208; 29/889.22; 277/413, 415

See application file for complete search history.

(56) References Cited

U.S. PATENT DOCUMENTS

| | | | | |
|---|---|---|---|---|
| 3,300,180 | A * | 1/1967 | Tuttle et al. | 415/138 |
| 3,313,520 | A * | 4/1967 | Ortolano et al. | 415/209.4 |
| 4,764,658 | A * | 8/1988 | Panzeri | 29/889.23 |
| 5,088,894 | A | 2/1992 | Patel | |
| 5,772,401 | A * | 6/1998 | Canova | 415/189 |
| 5,807,074 | A * | 9/1998 | Fournier et al. | 415/209.3 |
| 6,139,019 | A | 10/2000 | Dinc et al. | |
| 6,340,286 | B1 | 1/2002 | Aksit et al. | |
| 6,722,848 | B1 | 4/2004 | Couture et al. | |
| 6,742,988 | B2 * | 6/2004 | Mundra et al. | 415/191 |
| 6,761,530 | B1 | 7/2004 | Ginessin et al. | |
| 6,786,699 | B2 | 9/2004 | Shapiro et al. | |
| 6,896,482 | B2 | 5/2005 | Parry | |
| 6,908,279 | B2 | 6/2005 | Sullivan et al. | |
| 6,969,231 | B2 | 11/2005 | Ghasripoor et al. | |
| 7,001,145 | B2 | 2/2006 | Couture et al. | |
| 2004/0126225 | A1 * | 7/2004 | Ghasripoor et al. | 415/173.3 |

* cited by examiner

*Primary Examiner*—Igor Kershteyn
(74) *Attorney, Agent, or Firm*—Armstrong Teasdale LLP

(57) ABSTRACT

A rotary machine includes a rotor, a stationary machine casing extending around the rotor, and a bling assembly extending between the casing and the rotor. The machine also includes at least one rotor tip seal assembly and at least one shaft seal assembly. The seal assemblies have a groove configured to receive at least one seal ring band. A method of assembling a rotary machine is also provided. The method includes fabricating the bling assembly by providing two identical members comprising a mating surface and having a semi-circular profile. The method also includes coupling the two members together at their mating surfaces such that a circular ring is formed and such that the mating surfaces define a horizontal joint. The method further includes machining concentric, circular and annular radially inner and outer and airfoil portions within predetermined radial portions of the bling assembly. The method also includes forming at least one abradable layer over a plurality of seal ring bands and inserting the plurality of seal ring bands into the rotor tip and shaft seal ring grooves.

20 Claims, 6 Drawing Sheets

ROTARY MACHINES AND METHODS OF ASSEMBLING

BACKGROUND OF THE INVENTION

This invention relates generally to rotary machines and more particularly, to bling assemblies for use in a rotary machine.

At least some known steam turbines have a defined steam path which includes, in serial-flow relationship, a steam inlet, a turbine, and a steam outlet. Many of these steam turbines include stationary nozzle segments that channel a flow of steam towards rotating buckets, or turbine blades, that are coupled to a rotatable member. At least some known stationary nozzle segments include a plurality of airfoils that facilitate channeling the steam flow. Each nozzle segment, in conjunction with an associated row of buckets, is usually referred to as a turbine stage and most known steam turbines include a plurality of stages.

Some known steam turbines have a semi-circular radially outermost portion, sometimes referred to as a shroud, that is coupled to a semi-circular airfoil portion. Such airfoil portions are generally assembled by coupling a plurality of airfoils to a semi-circular band that is inserted into a dovetail groove defined within the shroud. Because the different steam turbine components may have been formed with differing manufacturing processes, specifications, and/or tolerances, the components may be assembled with cumulative dimensional deviations, known as stack-up tolerances, that may exceed overall tolerances. Because stack-up tolerances may increase manufacturing costs and/or reduce steam turbine efficiency, generally the tolerances of individual components may need to be decreased to facilitate mitigating any stack-up tolerances which may be created during assembly.

Moreover, some known steam turbines include airfoils that have been inserted within the assemblies with a pre-twist. The pre-twist induces predetermined stresses into the associated airfoils that facilitate absorbing and dampening dynamic stresses that may be induced during operation, while reducing long-term airfoil wear and misalignment. However, minute variances in the associated tooling and manufacturing environments may increase the difficulty in maintaining stringent process control tolerances in forming the aforementioned pre-twist and may outweigh any benefits that may be provided with the pre-twist.

BRIEF DESCRIPTION OF THE INVENTION

In one aspect, a method of assembling a rotary machine is provided. The rotary machine includes a casing extending at least partially around a rotor. The method includes providing at least two substantially identical members comprising a mating surface and having a substantially semi-circular cross-sectional profile. The method also includes assembling a bling assembly by coupling the at least two members together at their mating surfaces such that a substantially circular ring is formed and such that the mating surfaces define a substantially horizontal joint. The method further includes machining substantially concentric, circular and annular radially inner and outer and airfoil portions within predetermined radial portions of the bling assembly.

In another aspect, a bling assembly for a steam turbine is provided. The bling assembly includes a first member having a mating surface and a substantially semi-circular cross-sectional profile. The bling assembly also includes a second member having a mating surface and a substantially semi-circular cross-sectional profile. The second member is identical to the first member and is coupled against the first member along the mating surfaces. Each of the first and second members include a plurality of circumferentially spaced airfoils. Each of the plurality of airfoils extends between a radially outer bling portion and a radially inner bling portion.

In a further aspect, a rotary machine is provided. The rotary machine includes at least one rotor and at least one stationary machine casing extending at least partly circumferentially around the at least one rotor. The rotary machine also includes a bling assembly extending between the casing and the rotor. The bling assembly includes a first member and a second member. The first member includes a mating surface and has a substantially semi-circular cross-sectional profile. The second member includes a mating surface and has a substantially semi-circular cross-sectional profile. The second member is identical to the first member and is coupled against the first member along the mating surfaces. Each of the first and second members include a plurality of circumferentially spaced airfoils. Each of the plurality of airfoils extends between a radially outer bling portion and a radially inner bling portion.

DETAILED DESCRIPTION OF THE INVENTION

Figure 1:
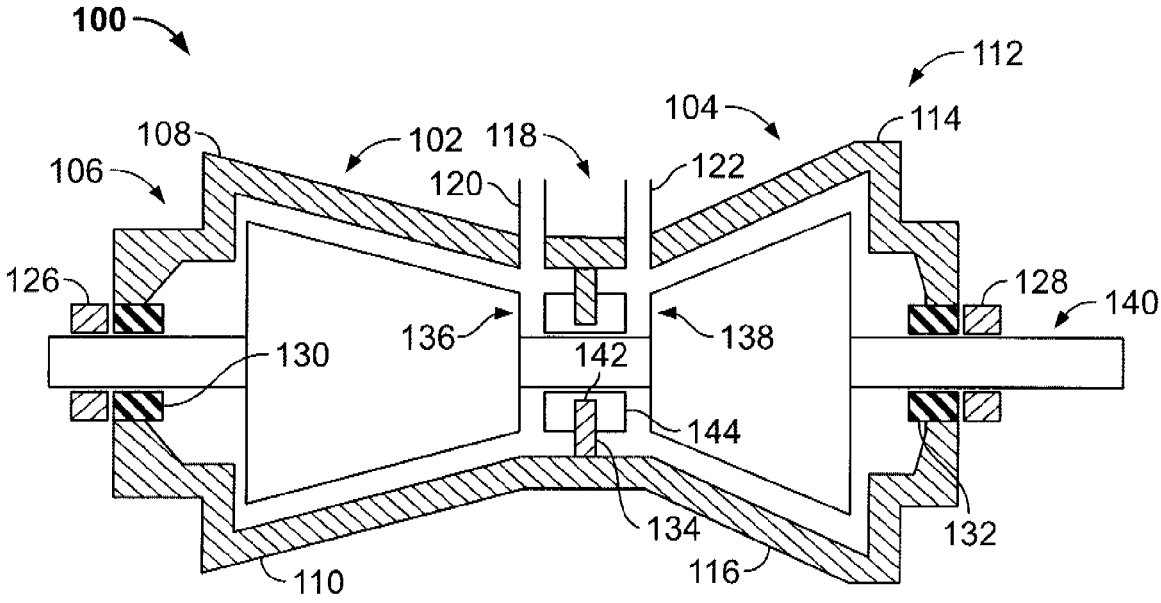
FIG. 1 is a cross-sectional schematic view of an exemplary opposed-flow steam turbine engine.

FIG. 1 is a cross-sectional schematic illustration of an exemplary opposed-flow steam turbine engine 100 including a high pressure (HP) section 102 and an intermediate pressure (IP) section 104. An HP shell, or casing, 106 is divided axially into upper and lower half sections 108 and 110, respectively. Similarly, an IP shell 112 is divided axially into upper and lower half sections 114 and 116, respectively. In the exemplary embodiment, shells 106 and 108 are inner casings. Alternatively, shells 106 and 108 are outer casings. A central section 118 positioned between HP section 102 and IP section 104 includes a high pressure steam inlet 120 and an intermediate pressure steam inlet 122. Within casings 106 and 112, HP section 102 and IP section 104, respectively, are arranged in a single bearing span supported by journal bearings 126 and 128. Steam seal apparatus 130 and 132 are located inboard of each journal bearing 126 and 128, respectively. In the exemplary embodiment, shells 106 and 108 are outer casings. Alternatively, shells 106 and 108 are inner casings.

An annular section divider 134 extends radially inwardly from central section 118 towards a rotor shaft 140 that extends between HP section 102 and IP section 104. More specifically, divider 134 extends circumferentially around a portion of rotor shaft 140 between a first HP section inlet nozzle 136 and a first IP section inlet nozzle 138. Divider 134 is received in a channel 142 defined in a packing casing 144. More specifically, channel 142 is a C-shaped channel that extends radially into packing casing 144 and around an outer circumference of packing casing 144, such that a center opening of channel 142 faces radially outwardly.

During operation, high pressure steam inlet 120 receives high pressure/high temperature steam from a steam source, for example, a power boiler (not shown in FIG. 1). Steam is routed through HP section 102 from inlet nozzle 136 wherein work is extracted from the steam to rotate rotor shaft 140 via a plurality of turbine blades, or buckets (not shown in FIG. 1) that are coupled to shaft 140. Each set of buckets includes a corresponding diaphragm (or, bling) assembly (not shown in FIG. 1) that facilitates routing of steam to the associated buckets. The steam exits HP section 102 and is returned to the boiler wherein it is reheated. Reheated steam is then routed to intermediate pressure steam inlet 122 and returned to IP section 104 via inlet nozzle 138 at a reduced pressure than steam entering HP section 102, but at a temperature that is approximately equal to the temperature of steam entering HP section 102. Work is extracted from the steam in IP section 104 in a manner substantially similar to that used for HP section 102 via a system of buckets and bling assemblies. Accordingly, an operating pressure within HP section 102 is higher than an operating pressure within IP section 104, such that steam within HP section 102 tends to flow towards IP section 104 through leakage paths that may develop between HP section 102 and IP section 104. One such leakage path may be defined extending through packing casing 144 axially along rotor shaft 140.

In the exemplary embodiment, steam turbine 100 is an opposed-flow high pressure and intermediate pressure steam turbine combination. Alternatively, steam turbine 100 may be used with any individual turbine including, but not being limited to low pressure turbines. In addition, the present invention is not limited to being used with opposed-flow steam turbines, but rather may be used with steam turbine configurations that include, but are not limited to single-flow and double-flow turbine steam turbines.

Figure 2:
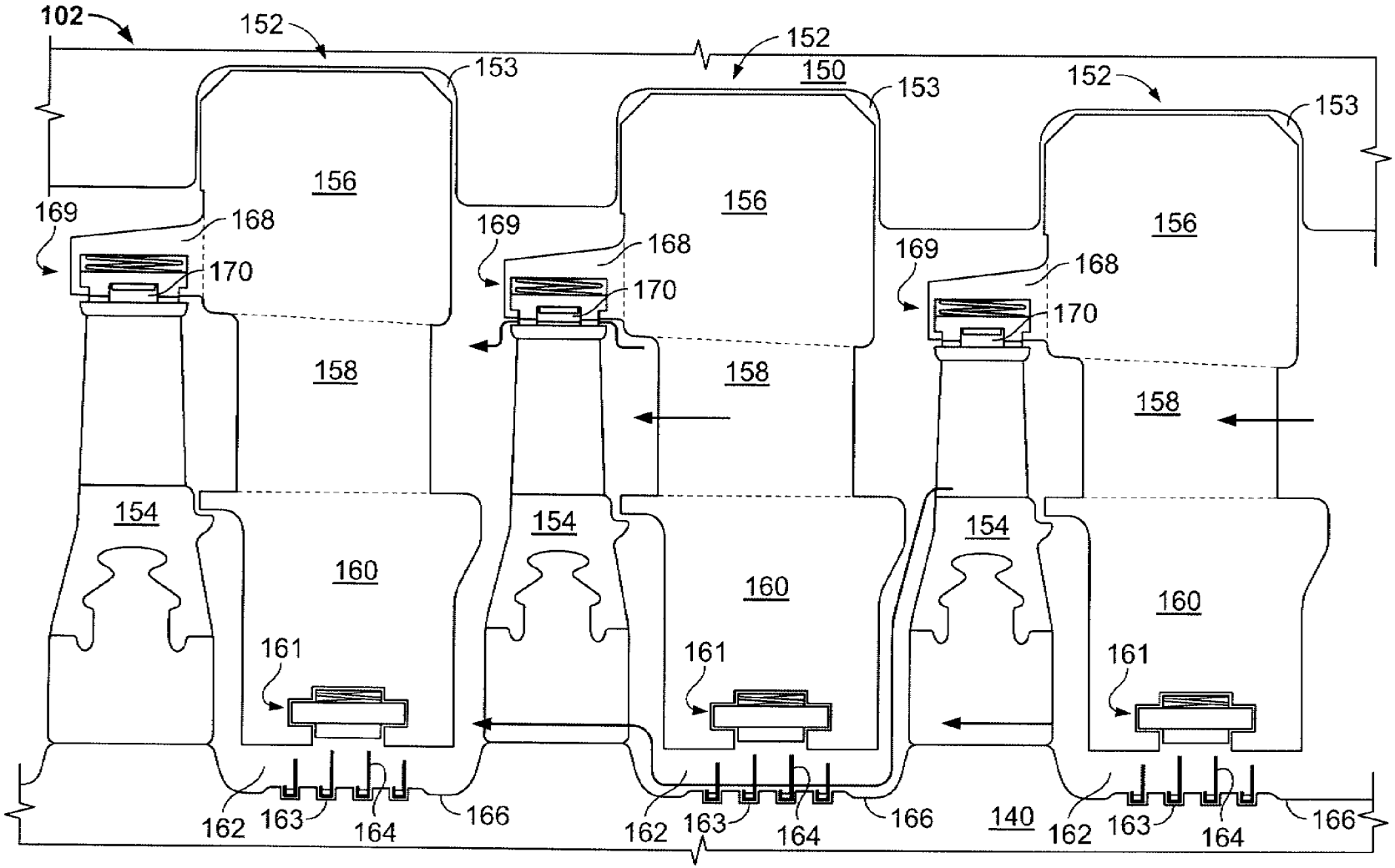
FIG. 2 is a cross-sectional schematic view of a high pressure (HP) section of the steam turbine engine shown in FIG. 1.

FIG. 2 is a cross-sectional schematic view of HP section 102 of steam turbine engine 100 (shown in FIG. 1). Section 102 includes an upper half casing that is bolted to a lower half casing (neither shown in FIG. 2) when section 102 is fully assembled. A nozzle carrier top half 150 mates to radially inner surfaces of the upper half casing such that nozzle carrier top half 150 acts as a radial inward extension of the casing. Such mating facilitates maintaining nozzle carrier top half 150 in a substantially fixed position with respect to turbine rotor 140. HP section 102 also includes a plurality of bling assemblies 152 and substantially annular carrier bling grooves 153. Nozzle carrier top half 150 facilitates substantially fixed support for nozzle 138 (shown in FIG. 1) as well as bling assemblies 152 via carrier bling grooves 153. A nozzle carrier bottom half (not shown in FIG. 2) is coupled to the lower half casing and receives the nozzle and bling assemblies 152 in a manner similar to nozzle carrier top half 150. HP section 102 further includes a plurality of rotatable turbine blades, or bucket assemblies 154 that are fixedly coupled to rotor 140. Bling assemblies 152 include a radially outer portion 156, a nozzle portion 158 and a radially inner portion 160. Bling assemblies 152 also include a seal carrier extension 168 coupled to radially outer portion 156. A plurality of radial gaps 170 are defined by a radially innermost portion of extensions 168 (sometimes referred to as a bucket tip seal 169) and a radially outermost portion of bucket assemblies 154. In the exemplary embodiment, extension 168 is fabricated integral to portion 156. Alternatively, extension 168 may be fabricated separately from bling assembly 152 and coupled to portion 156 as discussed in more detail below.

Rotor 140 includes a rotor surface 166. A plurality of radial gaps 162 are defined by rotor surface 166 and a radially innermost portion of bling 152 (sometimes referred to as a shaft seal 161). Rotor 140 also includes a plurality of substantially annular rotor grooves 163 formed within rotor surface 166. At least one substantially arcuate sealing strip 164 is fixedly coupled within each groove 163 via caulk (not shown in FIG. 2). A similar configuration (not shown in FIG. 2) exists in association with radial gaps 170.

In operation, steam enters section 102 via HP section steam inlet 122 (shown in FIG. 1) and is channeled through section 102 as illustrated by the arrows. Inlet nozzle 136 (shown in FIG. 1) and the associated bucket assembly (not shown in FIG. 2) define a first stage of engine 100. In the exemplary embodiment, three subsequent bucket assemblies 154 and three bling assemblies 152 as illustrated in FIG. 2 form three subsequent stages. Alternatively, any number of stages may be used with steam turbine 100. Inlet nozzle 136 and nozzles 158 facilitate channeling steam to bucket assemblies 154. Bling assemblies 152 facilitate mitigation of steam flow losses from the primary steam flow path of nozzle-to-bucket-to-nozzle, etc. via radial gap 162. Equalization passages (not shown in FIG. 2) are formed within bucket assemblies 154 and are dimensioned and positioned facilitate mitigating steam flow channeling through the equalization passages into gap 162 (as illustrated by the arrows in FIG. 2). Mitigation of steam flow losses are further facilitated in a similar fashion by seal carrier extensions 168 that are positioned radially adjacent to radially outer portion 156 to define radial gap 170. Bling assemblies 152 and the associated components are discussed further below.

Figure 3:
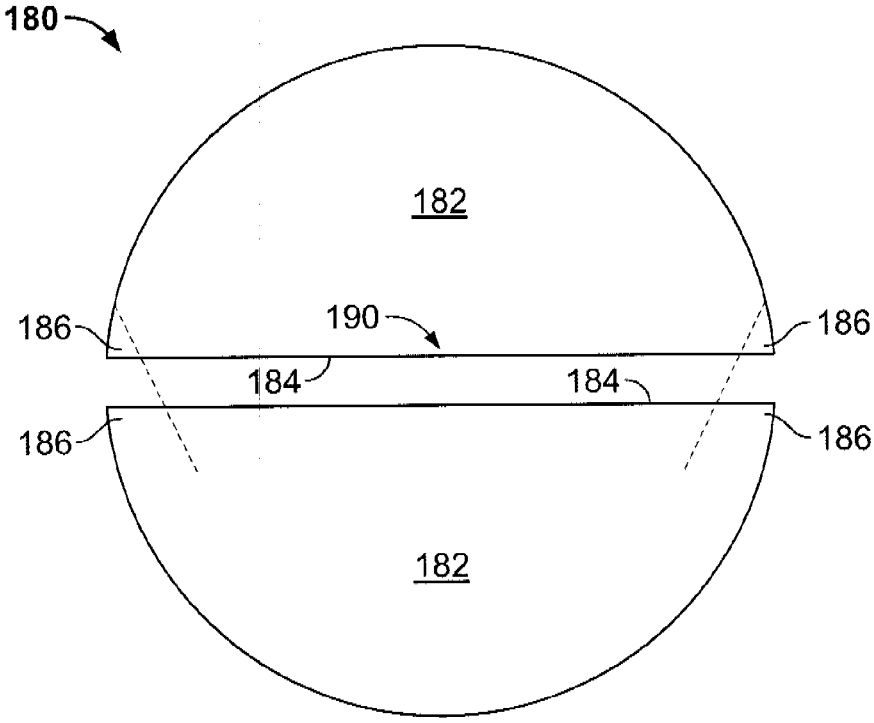
FIG. 3 is a cross-sectional schematic view of an exemplary member that can be used to form a bling assembly that can be used with the HP section shown in FIG. 2.

FIG. 3 is a cross-sectional schematic view of an exemplary substantially circular member 180 that may be used to form bling assembly 152 that may be used with HP section 102 (both shown in FIG. 2). Member 180 is formed by coupling two substantially semi-circular members 182, each member having a diametrically innermost mating surface 184. Members 182 may be fabricated by, but not be limited to casting, impression die forging or seamless rolled ring forging processes. Materials that may be used include, but are not limited to stainless steel and titanium alloys. The radial dimensions of members 182 are predetermined based on dimensional constraints that include, but are not limited to bling assembly's 152 position within steam turbine engine 100. The axial dimensions of members 182 are also based on similar dimensional constraints as well as bling assembly 152 formation processes that may include fabricating seal carrier extension 168 integrally with radially outermost portion 156 (both shown in FIG. 2) or as a separate unit to be coupled later in the assembly process.

In the exemplary embodiment, retention hardware (not shown in FIG. 3) includes, but is not limited to countersunk inboard fasteners that are positioned within radially outer portions 186 of members 182 such that the fasteners penetrate mating surfaces 184 as illustrated by the dashed lines to form member 180. Alternatively, a plurality of flanged portions (not shown in FIG. 3) may also be formed as integral portions of members 182. In this alternative embodiment, retention hardware (not shown in FIG. 3) may be used in cooperation with the flanges to couple members 182 to form member 180. The retention hardware may include, but not be limited to a nut and bolt combination. Also, alternatively, members 182 may be coupled by welding mating surfaces 184, however, using retention hardware facilitates subsequent member 180 disassembly for further machining as well as inserting and removing bling assembly 152 into and from nozzle carrier top half 150, respectively. Bling assembly horizontal joint 190 is defined by mating surfaces 184 when members 182 are coupled.

Figure 4:
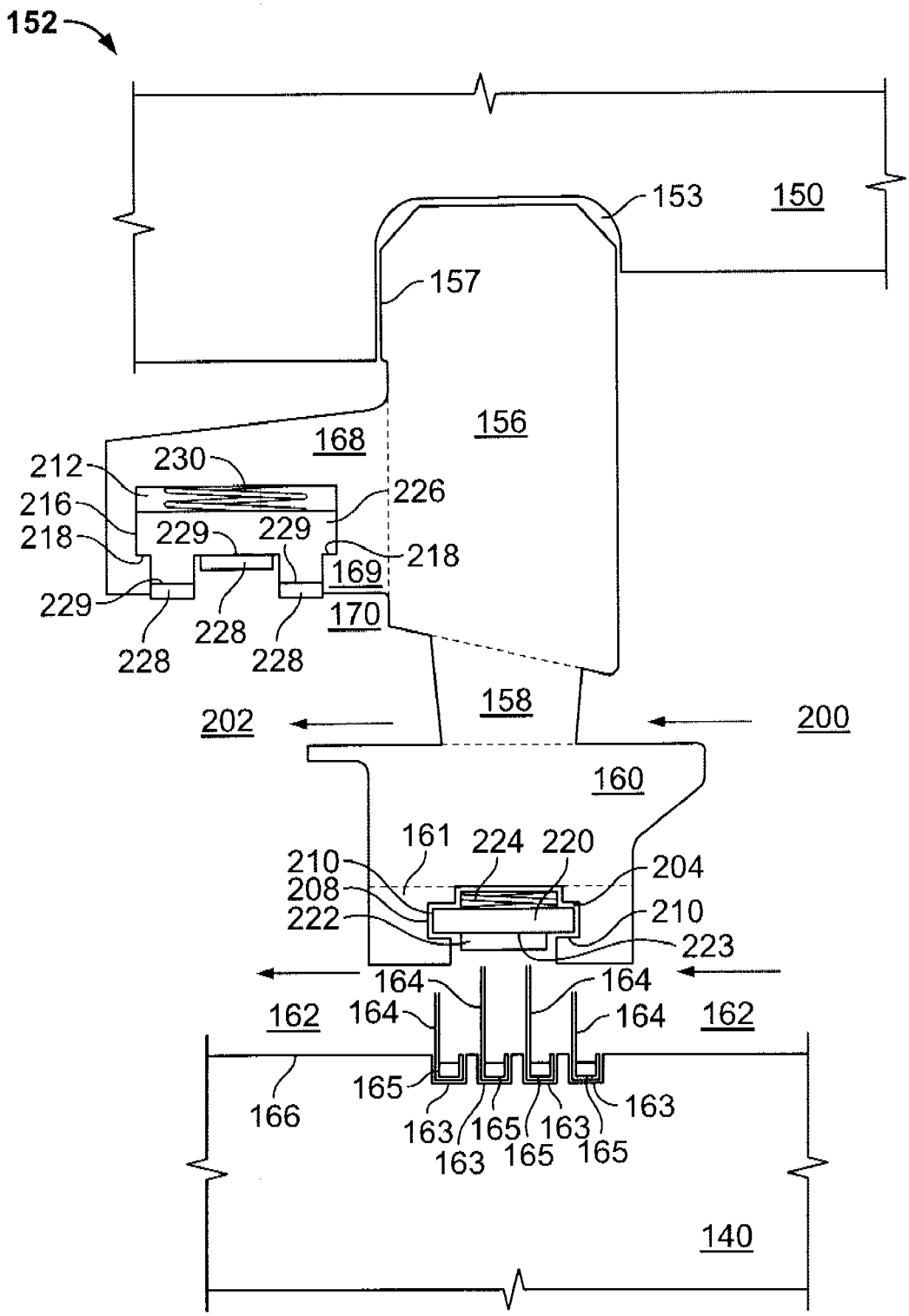
FIG. 4 is a cross-sectional schematic view of an exemplary bling assembly that may be fabricated using the member shown in FIG. 3.

FIG. 4 is a cross-sectional schematic view of exemplary bling assembly 152, that may be fabricated from member 180 (shown in FIG. 3), subsequent to insertion into engine 100. The dotted lines in FIG. 4 illustrate the differing portions of bling assembly 152 discussed in detail below. Steam flow across nozzle portion 158 is illustrated by the associated arrows from an upstream region 200 to a downstream region 202. FIG. 4 illustrates rotor 140, gap 162, rotor grooves 163, sealing strips 164, caulk 165, rotor surface 166, and gap 170 for perspective.

Figure 5:
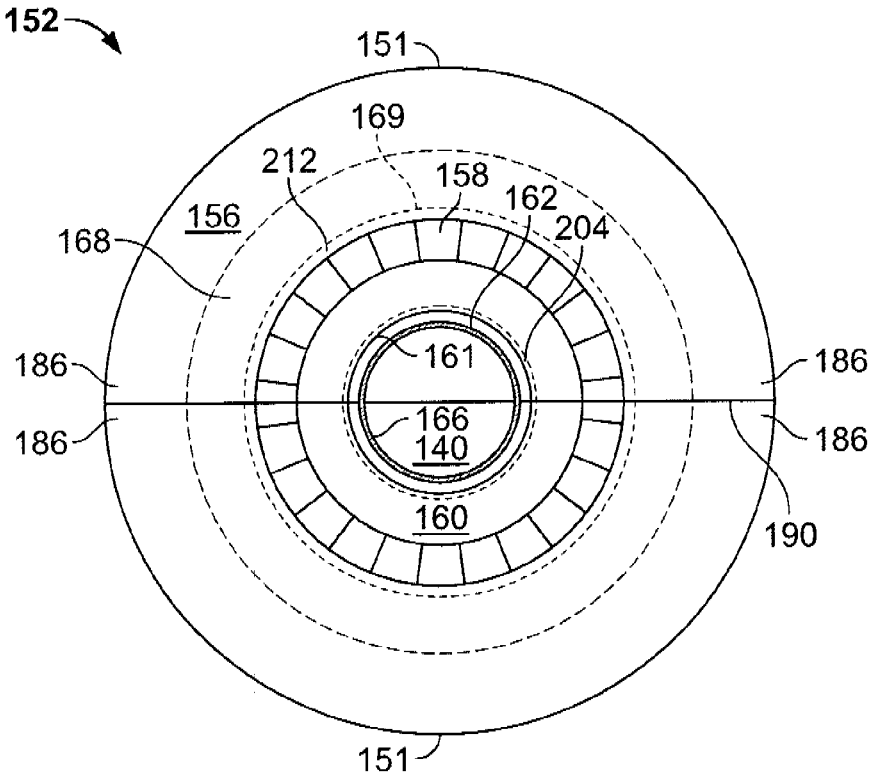
FIG. 5 is a cross-sectional schematic axial view of the bling assembly shown in FIG. 4.

FIG. 5 is a cross-sectional schematic axial view of exemplary bling assembly 152 subsequent to completion of machining and prior to disassembly (both discussed further below). The dotted lines illustrated in FIG. 5 are used to illustrate significant portions of bling assembly 152, for example extension 168, that have an axial dimension and may potentially obscure illustrating other significant portions. Rotor 140, rotor surface 166, radial gap 162 and horizontal joint 190 are illustrated for perspective. FIGS. 4 and 5 will be referenced in cooperation to describe bling assembly 152 fabrication.

Circular member 180 (shown in FIG. 3) is formed by coupling two semi-circular members 182 (shown in FIG. 3) with retention hardware through radially outer portions 186 as discussed above. Member 180 is inserted into a machining center (not shown in FIGS. 4 and 5).

Airfoil (or nozzle) portion 158 is the first portion of assembly 152 formed using machining techniques that are known in the art. Integrated into the machining techniques is forming a predetermined number of nozzles with predetermined positioning and dimensions within portion 158. Reducing dimensional tolerances associated with nozzle portion 158 may be facilitated by taking advantage of modern machining technologies and practices including, but not being limited to using an automated machining method that may include methods such as, but are not limited to numerical control methods. Forming the plurality of nozzles within portion 158 using consistent processes facilitates mitigating the potential for a reduction in axial clearances between bling assembly 152 and rotor surface 166 due to inconsistent nozzle formation within portion 158.

Radially outer portion 156 is formed within member 180 using equipment and practices similar to those used to form nozzle portion 158. Outer portion 156 is formed with predetermined dimensions that facilitate insertion into carrier bling grooves 153 formed within nozzle carrier top half 150. Furthermore, outer portion 156 is formed with a substantially annular protrusion 157 on at least a portion of a downstream face of portion 156 that serves as a steam sealing surface, or seal face strip 157. As with nozzle portion 156, dimensional tolerances associated with radially outer portion 156 may be reduced by taking advantage of modern machining technologies and practices as discussed above.

In the exemplary embodiment, seal carrier extension 168 is formed integrally with outer portion 156 and extends axially into downstream region 202. Alternatively, extension 168 may be fabricated independently with at least one flanged portion (not shown in FIGS. 4 and 5) and coupled to outer portion 156 using retention hardware (not shown in FIGS. 4 and 5) that may include, but not be limited to bolts and/or dowels. Also, alternatively, extension 168 may be caulked, welded or brazed to outer potion 156. Furthermore, alternatively, extension 168 may be formed with dovetailed or keyed extensions and inserted into dovetail or keyed grooves (neither shown in FIGS. 4 and 5) formed within the downstream face of outer portion 156.

Inner radial portion 160 is formed within member 180 using equipment and practices similar to those used to form nozzle portion 158 and radially outer portion 156. As with nozzle portion 158 and outer radial portion 156, dimensional tolerances associated with radially outer portion 156 may be reduced by taking advantage of modern machining technologies and practices as discussed above.

A substantially annular seal ring groove 204 is formed within radially inner portion 160 thereby at least partially forming shaft seal 161 of radially inner portion 160 using machining techniques as discussed above. Groove 204 is formed with predetermined dimensions that facilitate subsequent insertion of a plurality of components as discussed further below. Groove 204 includes an axially downstream sealing surface, or seal face 208 and a plurality of axially opposing seal band seating surfaces 210. Forming groove 204 while the two halves of assembly 152 are coupled facilitates reducing the potential for exceeding dimensional tolerances.

A substantially annular seal ring groove 212 is formed within extension 168 thereby at least partially forming bucket tip seal 169 of extension 168 in a manner similar to that used to form groove 204. Groove 212 is formed with predetermined dimensions that facilitate subsequent insertion of a plurality of components as discussed further below. Groove 212 includes an axially downstream sealing surface, or seal face 216 and a plurality of seal band seating surfaces 218. Forming groove 212 while the two halves of assembly 152 are coupled facilitates reducing the dimensional tolerances and subsequently facilitates mitigating the stack-up tolerances.

Bling assembly 152 with portions 156, 158 and 160 that is machined as described above is removed from the machining apparatus and is uncoupled at horizontal joint 190 by removing retention hardware 188 from flanges 186. This activity forms two semi-circular sections 151 of bling assembly 152 that are subsequently each reinserted into the machining apparatus. The remainder of the discussion will describe one of the sections 151 and substantially similar activities are performed on the other section 151.

At least one substantially arcuate seal ring band 220 is obtained. In the exemplary embodiment, band 220 is of sufficient length such that only one segment is inserted into each of sections 151 to obtain an 180 degree arc, i.e., two band segments 220 are used for each bling 152 to attain a 360 degree arc of band 220. Alternatively, a greater number of band segments 220 may be used to attain a 360 degree arc within bling 152. Band 220 may be formed of a flexible material and may have an arcuate shape that facilitates subsequent insertion into groove 204. In the exemplary embodiment, a plurality of abradable layers 222 is formed on substantially all of a radially innermost surface 223 of band 220. An initial base layer is formed by plasma spray methods known in the art. A subsequent topcoat layer is formed by powder metal flame spray methods known in the art. Alternatively, any combination of layer materials and forming methods may be used to attain predetermined operational parameters of band 200. Abradable layers 222 are abraded to within predetermined tolerances. Forming abradable layers 222 on plurality of bands 220 may facilitate reducing the time and costs associated with the coating activities by nesting bands 220 together and using batch layer forming methodologies with limited masking activities. In addition, on-hand replacement bands 220 that may need to be used during engine 100 outages may be obtained more readily and outage length reductions may be facilitated. Abradable layers 222 formed on bands 220 have wear characteristics that facilitate mitigating wear during transients wherein rotor surface 166 and abradable layers 222 may contact each other.

In an alternative embodiment, a plurality of labyrinth seal teeth (not shown in FIGS. 4 and 5) may be coupled to surface 223. As is known in the art, the seal teeth define a tortuous path that facilitates mitigating steam flow through gap 162. Subsequently, a portion of the abradable coating as described above may be positioned between the seal teeth to attain results similar to those attained with layer 222 alone.

In the exemplary embodiment, a plurality of seal springs 224 are inserted into a radially outermost portion of groove 204 at predetermined positions and are retained within groove 204 using methods that include, but are not limited to retention hardware and caulking (neither shown in FIGS. 4 and 5). Band 220 is subsequently inserted between springs 224 and seating surfaces 210. Also, in the exemplary embodiment, seal springs 224 are leaf-type springs. Alternatively, either coil-type springs or no springs may be inserted. In this alternative embodiment, band 220 with abradable layers 222 is inserted into groove 204. Seal springs 224 bias band 220 towards rotor surface 166 such that during normal operation of engine 100, gap 162 is facilitated to be maintained such that abradable layers 222 substantially do not touch rotor surface 166 while gap 162 is facilitated to be maintained at a small value. In the event of conditions that may cause rotor surface 166 to approach abradable layers 222, springs 224 will facilitate withdrawal of band 220 while maintaining gap 162 as small as practical.

At least one substantially arcuate seal ring band 226 is obtained. In the exemplary embodiment, band 226 is of sufficient length such that only one segment is inserted into each of bling assembly sections 151 to obtain an 180 degree arc, i.e., two band segments 226 are used for each bling 152 to attain a 360 degree arc of band 226. Alternatively, a greater number of band segments 226 may be used to attain a 360 degree arc within bling 152. Band 226 may be formed of a flexible material and may have an arcuate shape that facilitates subsequent insertion into groove 212. In the exemplary embodiment, band 226 includes two substantially annular radially inner surfaces 229 positioned between one substantially annular radially outer surface 229. Alternatively, bling assembly 152 may have any number of surfaces 229 in any axial and radial configuration.

A plurality of abradable layers 228 is formed on substantially all of surfaces 229 of band 226 in a manner substantially similar to that used for forming layers 222 on band 220 in order to attain similar results.

Forming abradable layers on a plurality of bands 226 may facilitate reducing the time and costs associated with the coating activities. In addition, on-hand replacement bands 226 that may need to be used during engine 100 outages may be obtained more readily and outage length reductions may be facilitated.

In an alternative embodiment, a plurality of labyrinth seal teeth (not shown in FIGS. 4 and 5) may be coupled to surfaces 229. As is known in the art, the seal teeth define a tortuous path that facilitates mitigating steam flow through gap 170. Subsequently, a portion of the abradable coating as described above may be positioned between the seal teeth to attain results similar to those attained with layer 228 alone.

In the exemplary embodiment, a plurality of seal springs 230 are inserted into a radially outermost portion of groove 212 at predetermined positions and are retained within groove 212 using methods that include, but are not limited to retention hardware and caulking (neither shown in FIGS. 4 and 5). Band 226 is subsequently inserted between springs 230 and seating surfaces 218. Also, in the exemplary embodiment, seal springs 230 are leaf-type springs. Alternatively, either coil-type springs or no springs may be inserted. In this alternative embodiment, band 226 with abradable layers 228 is inserted into groove 212. Seal springs 230 bias band 226 towards bucket assembly 154 (shown in FIG. 2) such that during normal operation of engine 100, gap 170 is facilitated to be maintained such that abradable layers 228 do not touch bucket assembly 154 while gap 170 is facilitated to be maintained at a small value. In the event of conditions that may cause bucket assembly 154 to approach abradable layers 228, springs 230 will facilitate withdrawal of band 226 while maintaining gap 170 as small as practical, thus mitigating a potential for a hard rub, or contact, between abradable layers 228 and bucket assembly 154.

Each section 151 of bling assembly 152 is removed from the machining apparatus and are inserted (sometimes referred to as "rolled") into carrier groove 153 in nozzle carrier top half 150. Alignment and retention hardware (not shown in FIGS. 4 and 5) and methods known in the art are used to secure bling assembly 152 within steam turbine 100 (shown in FIG. 1).

Typically, as described herein, bling assemblies such as assembly 152 are fabricated by taking advantage of modern machining technologies and practices including, but not being limited to using an automated machining method that may include methods such as, but are not limited to numerical control methods. In contrast, typically, diaphragm assemblies (that may also be used to facilitate turbine operation as described herein in a similar manner) are fabricated by first fabricating individual diaphragm portions and subsequently welding individual portions to form an integral diaphragm assembly. In general, the fabrication methods for bling assembly 152 may substantially reduce a potential for introduction of material and fabrication inconsistencies and permit smaller tolerances in the finished assembly.

For example, forming a plurality of nozzles within a diaphragm assembly may have inherent process inconsistencies that incorporate inconsistent nozzle sizing and positioning that may subsequently increase stack-up tolerances. Specifically, minute variances in the associated tooling and manufacturing environments may increase the difficulty in maintaining stringent process control tolerances in forming the nozzles. Therefore, forming the plurality of nozzles within portion 158 using consistent processes in member 180 as described herein facilitates mitigating the potential for a reduction in axial clearances between bling assembly 152 and rotor surface 166 due to inconsistent nozzle formation in portion 158. Similar tolerance reduction results may be attained throughout the bling assembly 152 fabrication process.

In addition, in-process assembly checks that are typically included with diaphragm assembly fabrication that include, but are not limited to twist, shingling, throat area measurements, and standing assembled modal tests may not be necessary when fabricating and assembling bling assembly 152 as described herein, thereby potentially facilitating a reduction in the amount of time used for bling 152 fabrication and assembly as compared to a diaphragm assembly.

When turbine engine 100 (shown in FIG. 1) is placed in service, high pressure steam is channeled through nozzle portion 158 from upstream region 200 to downstream region 202. Steam pressure in region 200 is typically higher than steam pressure in region 202. Therefore, the differential steam pressure induces a force that positions band 220 against seal face 208, seal face 157 against a downstream wall of groove 153, and band 226 against seal face 216, thereby forming at least three seals to facilitate mitigating steam flow that may bypass nozzles portion 158 and gaps 162 and 170.

FIGS. 6, 7, 8 and 9 are cross-sectional schematic views of alternative bling assemblies 152 that may be fabricated using member 180 (shown in FIG. 3).

Figure 6:
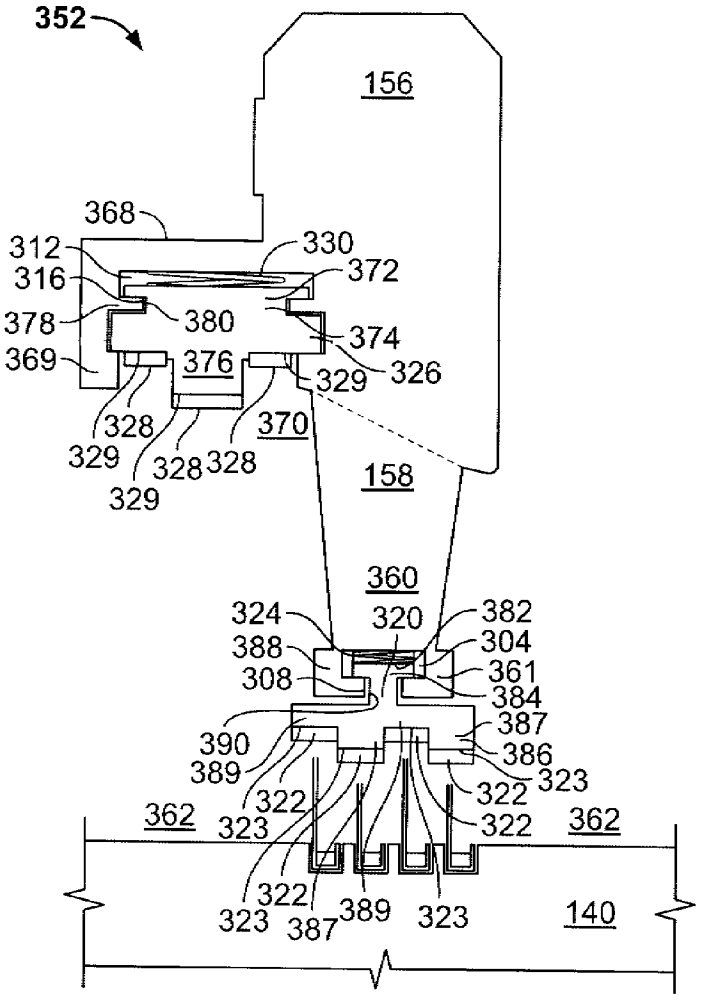
FIG. 6 is a cross-sectional schematic view of an alternative embodiment of a bling assembly that may be fabricated using the member shown in FIG. 3.

FIG. 6 illustrates an alternative bling assembly 352. Radially outer portion 156 and nozzle portion 158 of bling assembly 352 are substantially similar to portion 156 and portion 158 of bling assembly 152 (shown in FIG. 4). Rotor 140 is illustrated for perspective. Bling assembly 352 includes a seal carrier extension 368. Seal carrier extension 368 differs from seal carrier extension 168 (shown in FIG. 4) by an alternative extension seal ring groove 312 that receives an alternative seal ring extension band 326 and plurality of alternative seal springs 330 within alternative bucket tip seal 369 that facilitates mitigating steam flow through a radial gap 370. In this alternative embodiment, springs 330 are leaf-type springs. Alternatively, springs 330 may be coil-type springs. Groove 312 is formed to receive band 326 that includes three portions as compared to one portion associated with band 226 (shown in FIG. 4). In this alternative embodiment, band 326 includes a radially outer portion 372, a neck portion 374 and a radially inner portion 376. Radially inner portion 376 extends radially inward from neck portion 374. Alternatively, band 326 may have any number of portions in any axial and radial configuration. In this alternative embodiment, band 326 includes a plurality of abradable layers 328 on surface 329 of portion 376 positioned between two pluralities of abradable layers 328 on surfaces 329 of portion 372. Alternatively, seal teeth (not shown in FIG. 6) may be coupled to surfaces 329 and abradable coating may be positioned between the teeth as described above. A substantially annular axially downstream protrusion 378 includes a sealing surface, or seal face 316 that cooperates with a substantially annular axially downstream surface 380 of neck portion 374 to facilitate mitigating steam flow through seal ring groove 312.

Bling assembly 352 also includes a radially inner portion 360 that differs from radially inner portion 160 (shown in FIG. 4) by an alternative extension seal ring groove 304 that receives an alternative seal ring band 320 and plurality of alternative seal springs 324 within an alternative shaft seal 361. In this alternative embodiment, seal springs 324 are leaf-type springs. Alternatively, springs 330 may be coil-type springs. Groove 304 is formed to receive band 320 that includes three portions as compared to one portion associated with band 220 (shown in FIG. 4). In this alternative embodiment, band 320 includes a radially outer portion 382, a neck portion 384 and a radially inner portion 386. Portion 386 includes two substantially annular radially inner portions 387 and two substantially annular radially outer portions 389 in an alternating sequence that facilitates mitigating steam flow through radial gap 362. Portions 387 and 389 extend radially inward from portion 386. Alternatively, portion 386 may have any number of inner and outer portions 387 and 389, respectively, in any axial and radial configuration. A plurality of abradable layers 322 is formed on a plurality of radially innermost surfaces 323 of portions 387 and 389. Alternatively, seal teeth (not shown in FIG. 6) may be coupled to surfaces 323 and abradable coating may be positioned between the teeth as described above. A substantially annular axially downstream protrusion 388 includes a sealing surface, or seal face 308 that cooperates with a substantially annular axially downstream surface 390 of neck portion 384 to facilitate mitigating steam flow through groove 304.

Figure 7:
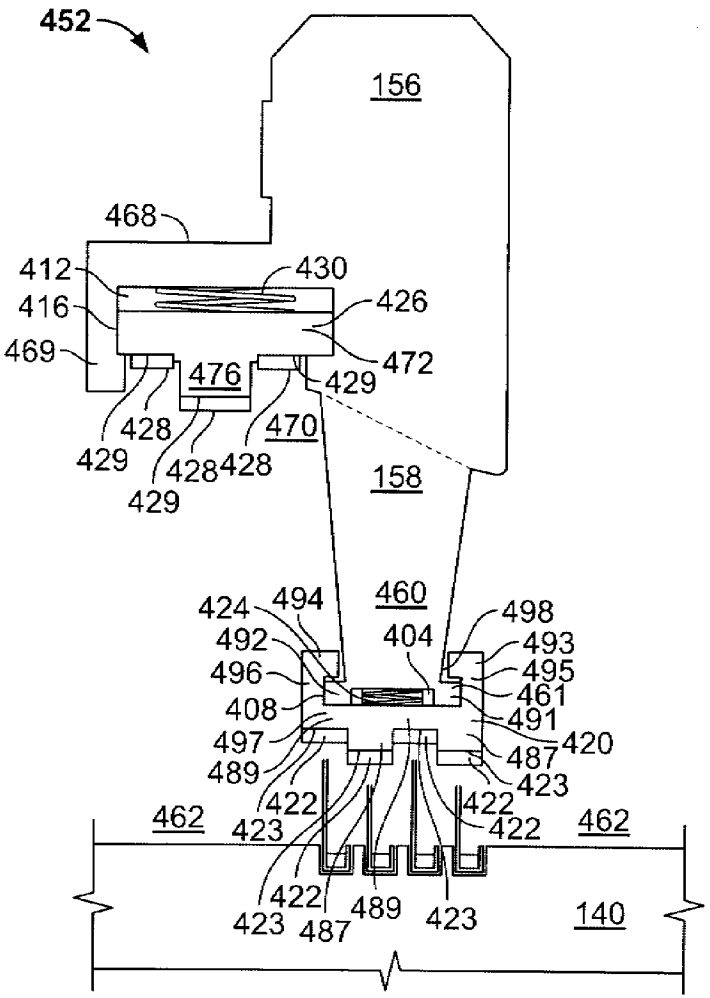
FIG. 7 is a cross-sectional schematic view of an alternative embodiment of a bling assembly that may be fabricated using the member shown in FIG. 3.

FIG. 7 illustrates an alternative bling assembly 452. Radially outer portion 156 and nozzle portion 158 in bling assembly 452 are substantially similar to portion 156 and portion 158 in bling assembly 152 (shown in FIG. 4). Rotor 140 is illustrated for perspective. Bling assembly 452 includes a seal carrier extension 468. Seal carrier extension 468 is substantially similar to seal carrier extension 168 (shown in FIG. 4) wherein an extension seal ring groove 412, a bucket tip seal 469, an axially downstream sealing surface, or seal face 416, and seal springs 430 are substantially similar to equivalent components in bling assembly 152 (shown in FIG. 4). An extension seal ring band 426 that is positioned within groove 412 differs from seal ring band 226 (shown in FIG. 4) in that in this alternative embodiment band 426 includes a radially outer portion 472 and a radially inner portion 476, both portions having at least one radially innermost surface 429. Alternatively, band 426 may have any number of portions in any axial and radial configuration. A plurality of abradable layers 428 is formed on surfaces 429. Alternatively, seal teeth (not shown in FIG. 7) may be coupled to surfaces 429 and abradable coating may be positioned between the teeth as described above.

Bling assembly 452 includes a radially inner portion 460 that differs from radially inner portion 160 by an alternative extension seal ring groove 404 that receives a plurality of alternative seal springs 424 and a pair of substantially annular axially upstream and downstream protrusions, 491 and 492 respectively, on an alternative shaft seal 461. In this alternative embodiment, seal springs 424 are leaf-type springs. Alternatively, springs 424 may be coil-type springs. An alternative seal ring band 420 includes a pair of substantially annular radially outer axially upstream and downstream protrusions 493 and 494, respectively, a pair of axially upstream and downstream neck portions 495 and 496, respectively, and a substantially annular radially inner portion 497. Portion 497 includes two substantially similar annular radially inner portions 487 and two substantially annular radially outer portions 489 in an alternating sequence that facilitates mitigating steam flow through radial gap 462. Portions 487 extend radially inward from portion 486. Alternatively, portion 486 may have any number of inner and outer portions 487 and 489, respectively, in any axial and radial configuration. A plurality of abradable layers 422 is formed on a plurality of radially innermost surfaces 423 of portions 487 and 489. Alternatively, seal teeth (not shown in FIG. 7) may be coupled to surfaces 423 and abradable coating may be positioned between the teeth as described above. Band protrusions 493 and 494, band neck portions 495 and 496 and band inner portion 497 cooperate to define a substantially annular seal band groove 498. Band 420 is coupled to shaft seal 461 by inserting band 420 over protrusions 491 and 492 via groove 498. Portion 496 includes an axially downstream sealing surface, or seal face 408 that facilitates mitigating steam flow through groove 498 in cooperation with protrusion 492.

Figure 8:
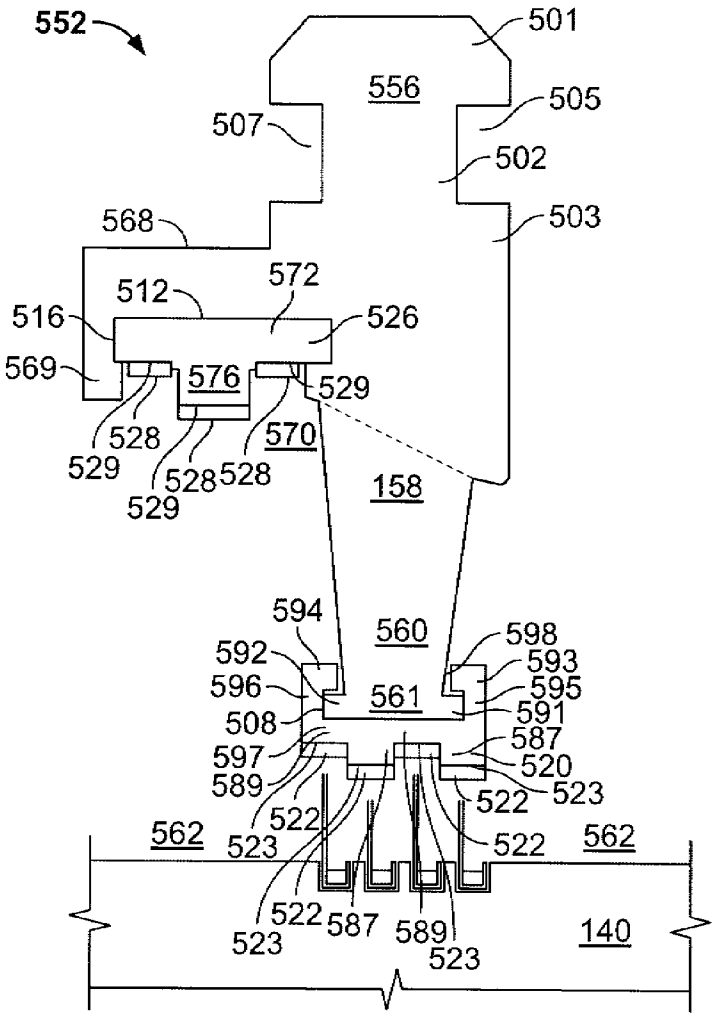
FIG. 8 is a cross-sectional schematic view of an alternative embodiment of a bling assembly that may be fabricated using the member shown in FIG. 3.

FIG. 8 illustrates an alternative bling assembly 552. Nozzle portion 158 in bling assembly 552 is substantially similar to portion 158 in bling assembly 152 (shown in FIG. 4). Rotor 140 is illustrated for perspective. Bling assembly 552 includes a radially outer portion 556 that differs from radially outer portion 156 (shown in FIG. 4) in that portion 556 includes three distinct regions, i.e., a substantially annular radially outer region 501, a substantially annular neck region 502, and a substantially annular radially inner region 503. Regions 501, 502 and 503 cooperate to define a pair of substantially annular axially upstream and axially downstream grooves 505 and 507, respectively. Grooves 505 and 507 facilitate insertion of bling assembly 552 into an alternative nozzle carrier top half (not shown in FIG. 8).

Bling assembly 552 also includes a seal carrier extension 568 that is similar to seal carrier extension 468 (shown in FIG. 7) with the exception that groove 512 formed in bucket tip seal 569 does not include provisions for seal springs. Alternatively, a plurality of seal springs (not shown in FIG. 8) may be used in a manner similar to seal spring 230 (shown in FIG. 4). An extension seal ring band 526 is inserted into groove 512. Groove 512 is at least partially defined by axially downstream sealing surface, or seal face 516 that cooperates with an axially downstream surface of band 526 to facilitate mitigating steam flow through groove 512. Extension seal ring band 426 differs from seal ring band 226 (shown in FIG. 4) in that in this alternative embodiment band 526 includes a radially outer portion 572 and a radially inner portion 576, both portions having at least one radially innermost surface 529. Alternatively, band 526 may have any number of portions in any axial and radial configuration. A plurality of abradable layers 528 is formed on surfaces 529. Alternatively, seal teeth (not shown in FIG. 8) may be coupled to surfaces 529 and abradable coating may be positioned between the teeth as described above.

Bling assembly 552 further includes a radially inner portion 560 that is similar to radially inner portion 460 (shown in FIG. 7) with the exception that no groove is provided to receive seal springs within a shaft seal 561. Alternatively, a plurality of seal springs (not shown in FIG. 8) may be used in a manner similar to seal spring 224 (shown in FIG. 4). Radially inner portion 560 differs from radially inner portion 160 (shown in FIG. 4) by a pair of substantially annular axially upstream and downstream protrusions, 591 and 592 respectively, on alternative shaft seal 561. An alternative seal ring band 520 includes a pair of substantially annular radially outer axially upstream and downstream protrusions 593 and 594, respectively, a pair of axially upstream and downstream neck portions 595 and 596, respectively, and a substantially annular radially inner portion 597. Portion 597 includes two substantially similar annular radially inner portions 587 and two substantially annular radially outer portions 589 in an alternating sequence that facilitates mitigating steam flow through radial gap 562. Portions 587 extend radially inward from portion 586. Alternatively, portion 586 may have any number of inner and outer portions 587 and 589, respectively, in any axial and radial configuration. A plurality of abradable layers 522 is formed on a plurality of radially innermost surfaces 523 of portions 587 and 589. Alternatively, seal teeth (not shown in FIG. 8) may be coupled to surfaces 523 and abradable coating may be positioned between the teeth as described above. Band protrusions 593 and 594, band neck portions 595 and 596 and band outer portion 597 cooperate to define a substantially annular seal band groove 598. Band 520 is coupled to shaft seal 561 by inserting band 520 over protrusions 591 and 592 via groove 598. Portion 596 includes an axially downstream sealing surface, or seal face 508 that facilitates mitigating steam flow through groove 598 in cooperation with protrusion 596.

Figure 9:
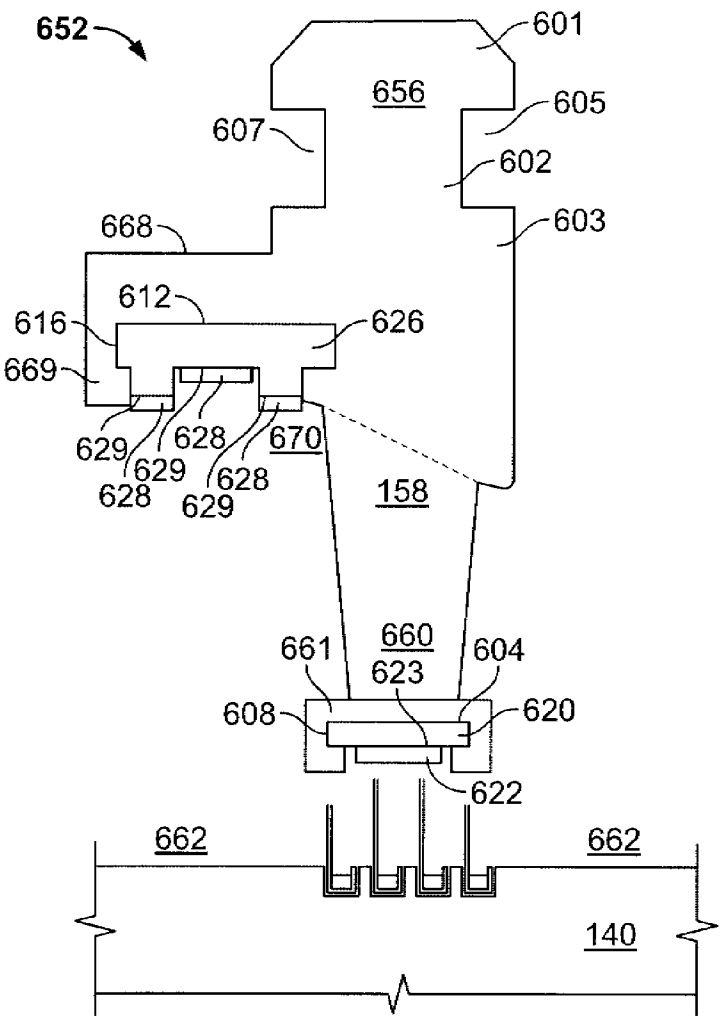
FIG. 9 is a cross-sectional schematic view of an alternative embodiment of a bling assembly that may be fabricated using the member shown in FIG. 3.

FIG. 9 illustrates an alternative bling assembly 652. Nozzle portion 158 in bling assembly 652 is substantially similar to portion 158 in bling assembly 152 (shown in FIG. 4). Rotor 140 is illustrated for perspective. Bling assembly 652 includes a radially outer portion 656. Radially outer portion 656 differs from radially outer portion 156 (shown in FIG. 4) in that portion 656 includes three distinct regions, i.e., a substantially annular radially outer region 601, a substantially annular neck region 602, and a substantially annular radially inner region 603. Regions 601, 602 and 603 cooperate to form a pair of substantially annular axially upstream and axially downstream grooves 605 and 607, respectively. Grooves 605 and 607 facilitate insertion of bling assembly 652 into an alternative nozzle carrier top half (not shown in FIG. 9).

Bling assembly 652 also includes a seal carrier extension 668 that is similar to seal carrier extension 168 (shown in FIG. 4) with the exception that a groove 612 formed in a bucket tip seal 669 includes no provision for a seal spring. Alternatively, a plurality of seal springs (not shown in FIG. 9) may be used in a manner similar to seal spring 230 (shown in FIG. 4). An extension seal ring band 626 is inserted into groove 612. An axially downstream sealing surface, or seal face 616 that partially defines groove 612 facilitates mitigating steam flow through groove 612 in cooperation with an axially downstream surface of band 626. An extension seal ring band 626 is substantially similar to seal ring band 226 (shown in FIG. 4) to facilitate mitigating steam flow through a radial gap 670. A plurality of abradable layers 628 is formed on a plurality of surfaces 629. Alternatively, seal teeth (not shown in FIG. 9) may be coupled to surfaces 629 and abradable coating may be positioned between the teeth as described above.

Bling assembly 652 further includes a radially inner portion 660 that is similar to radially inner portion 160 (shown in FIG. 4) with the exception that a groove 604 formed in a shaft seal 661 includes no provision for seal springs. Alternatively, a plurality of seal springs (not shown in FIG. 9) may be used in a manner similar to seal spring 224 (shown in FIG. 4). A seal ring band 620 is inserted into groove 604. An axially downstream sealing surface 608 that partially defines groove 604 facilitates mitigating steam flow through groove 604 in cooperation with an axially downstream surface of band 620. In this alternative embodiment, band 620 is substantially similar to band 220 (shown in FIG. 4) to facilitate mitigating steam flow through a radial gap 662. A plurality of abradable layers 622 is formed on a radially innermost surface 623 of band 620. Alternatively, seal teeth (not shown in FIG. 9) may be coupled to surfaces 623 and abradable coating may be positioned between the teeth as described above.

One advantage of bling assemblies 152, 352 and 452 (shown in FIGS. 4, 6 and 7, respectively) is that without the radially outer portion dovetail arrangement as illustrated in bling assemblies 552 and 662 (shown in FIGS. 8 and 9, respectively), alignment and fit adjustments after insertion may be facilitated.

Bling assemblies 552 and 662 may need to be segmented into more than two semi-circular segments to allow for a variety of operational considerations that include, but are not limited to, thermal expansion and the associated stress distribution of portions 556 and 656, respectively. For example, circular member 180 may be formed of four or more partially circular members.

The methods and apparatus for a fabricating a turbine bling assembly described herein facilitates operation of a turbine system. More specifically, the turbine bling assembly as described above facilitates a more robust turbine steam seal configuration. Such steam seal configuration also facilitates efficiency, reliability, and reduced maintenance costs and turbine system outages.

Exemplary embodiments of turbine bling assemblies as associated with turbine systems are described above in detail. The methods, apparatus and systems are not limited to the specific embodiments described herein nor to the specific illustrated turbine bling assembly.

While the invention has been described in terms of various specific embodiments, those skilled in the art will recognize that the invention can be practiced with modification within the spirit and scope of the claims.

What is claimed is:

1. A method of assembling a rotary machine including a casing, said method comprising:

providing at least two substantially identical members comprising a mating surface and having a substantially semi-circular cross-sectional profile;

assembling a bling assembly by coupling the at least two members together at their mating surfaces such that a substantially circular ring is formed and such that the mating surfaces define a substantially horizontal joint;

machining substantially concentric, circular and annular radially inner and outer and airfoil portions within predetermined radial portions of the bling assembly;

machining a seal ring carrier extension adjacent to the radially outer portion of the airfoil, wherein the seal ring carrier extension is formed integrally with the outer portion, and wherein the seal ring carrier extension includes a first seal ring groove that is at least partially defined by an axially downstream wall and by at least one seal band seating surface, said axially downstream wall at least partially defines a steam sealing surface; and inserting at least one seal ring band into the first seal ring groove and positioning a plurality of springs between the at least one seal ring band and at least a portion of the seal ring carrier extension.

2. A method of assembling a rotary machine in accordance with claim 1 wherein coupling the two substantially semi-circular members at the radially inner mating surfaces comprises coupling the two members using retention hardware.

3. A method of assembling a rotary machine in accordance with claim 1 wherein machining substantially concentric, circular and annular radially inner and outer and airfoil portions further comprises:

machining a second seal ring groove within the radially inner portion, the second groove being at least partially defined by an axially downstream wall, at least a portion of the wall defining a steam sealing surface; and machining an axially downstream surface over the radially outer portion, at least a portion of the surface defining a steam sealing face.

4. A method of assembling a rotary machine in accordance with claim 1 further comprising:

machining at least one seal ring groove in at least a portion of the radially inner portion;

forming at least one abradable layer over a plurality of seal ring bands and inserting the plurality of seal ring bands into the seal ring grooves; and positioning the bling assembly in a gap formed by the casing and a rotor.

5. A method of assembling a rotary machine in accordance with claim 1 further comprising forming the seal carrier extension by machining the bling assembly radially outer portion.

6. A method of assembling a rotary machine in accordance with claim 1 further comprising assembling the uncoupled seal carrier extension and coupling the assembled extension to the bling assembly radially outer portion.

7. A method of assembling a rotary machine in accordance with claim 4 wherein forming at least one abradable layer comprises spraying an abradable material over at least a portion of the surface regions of the plurality of seal ring bands and abrading the layers to within predetermined tolerances.

8. A method of assembling a rotary machine in accordance with claim 4 wherein positioning the bling assembly in a gap formed by the casing and a rotor comprises fixedly coupling the bling assembly to the rotary machine casing at a conjunction of the bling horizontal joint and a casing horizontal joint.

9. A bling assembly for a steam turbine comprising:

a first member comprising a mating surface and having a substantially semi-circular cross-sectional profile; and a second member comprising a mating surface and having a substantially semi-circular cross-sectional profile, said second member is identical to said first member and is coupled against said first member along said mating surfaces, each of said first member and said second member comprising a plurality of circumferentially spaced airfoils, each of said plurality of airfoils extends between a radially outer bling portion and a radially inner bling portion, said radially outer bling portion comprising a seal ring carrier extension, said seal ring carrier extension is formed integrally with said outer bling portion and comprises a first seal ring groove that is at least partially defined by an axially downstream wall and by at least one seal band seating surface, said axially downstream wall at least partially defines a steam sealing surface, wherein said seal ring carrier extension comprises at least one seal ring band within said first seal ring groove and a plurality of springs extending between said seal ring band and at least a portion of said seal ring carrier extension.

10. A bling assembly in accordance with claim 9 wherein said radially inner bling portion comprises at least one substantially annular seal ring groove defined therein, said groove being at least partially defined by a steam sealing face.

11. A bling assembly in accordance with claim 10 wherein said radially inner bling portion further comprises:

a seal ring band positioned within said seal ring groove, wherein at least a portion of said seal ring band comprises at least one abradable layer; and a plurality of springs radially outward of said seal ring band and biased between said seal ring band and a portion of said radially inner bling portion.

12. A bling assembly in accordance with claim 9 wherein said seal ring carrier extension is substantially annular and extends downstream a distance from said plurality of airfoils, said at least one seal ring band comprising at least one abradable layer formed over at least a portion of said seal ring band.

13. A bling assembly in accordance with claim 9 wherein said radially outer bling portion comprises a downstream surface and an opposite upstream surface, at least a portion of said downstream surface defines a steam sealing face.

14. A bling assembly in accordance with claim 9 wherein said radially outer bling portion comprises at least one flange extending radially outward from said outer bling portion, said flange facilitates coupling said bling assembly within the steam turbine assembly.

15. A rotary machine comprising:

at least one rotor;

at least one stationary machine casing extending at least partly circumferentially around said at least one rotor; and a bling assembly extending between said casing and said rotor comprising a first member and a second member, said first member comprising a mating surface and having a substantially semi-circular cross-sectional profile, said second member comprising a mating surface and having a substantially semi-circular cross-sectional profile, said second member is identical to said first member and is coupled against said first member along said mating surfaces, each of said first member and said second member comprising a plurality of circumferentially spaced airfoils, each of said plurality of airfoils extends between a radially outer bling portion and a radially inner bling portion, said radially outer bling portion comprising a seal ring carrier extension, said seal ring carrier extension is formed integrally with said outer bling portion and comprises a first seal ring groove that is at least partially defined by an axially downstream wall and by at least one seal band seating surface, said axially downstream wall at least partially defines a steam sealing surface, said seal ring carrier extension comprises at least one seal ring band positioned within said first seal ring groove and a plurality of springs extending between said at least one seal ring band and at least a portion of said seal ring carrier extension.

16. A rotary machine in accordance with claim 15 said radially inner bling portion comprises at least one substantially annular seal ring groove defined therein, said groove being at least partially defined by a steam sealing face.

17. A rotary machine in accordance with claim 16 wherein said radially inner bling portion further comprises:

a seal ring band positioned within said seal ring groove, wherein at least a portion of said seal ring band comprises at least one abradable layer; and a plurality of springs radially outward of said seal ring band and biased between said seal ring band and a portion of said radially inner bling portion.

18. A rotary machine in accordance with claim 15 wherein said seal ring carrier extension is substantially annular and extends downstream a distance from said plurality of airfoils, said at least one seal ring band comprising at least one abradable layer formed over at least a portion of said seal ring band.

19. A rotary machine in accordance with claim 15 wherein said radially outer bling portion comprises a downstream surface and an opposite upstream surface, at least a portion of said downstream surface defines a steam sealing face.

20. A rotary machine in accordance with claim 15 wherein said radially outer bling portion comprises at least one flange extending radially outward from said outer bling portion, said flange facilitates coupling said bling assembly within the rotary machine.

* * * * *